United States Patent [19]

Harada et al.

[11] Patent Number: 4,836,774

[45] Date of Patent: Jun. 6, 1989

[54] METHOD AND APPARATUS FOR HEATING A STRIP OF METALLIC MATERIAL IN A CONTINUOUS ANNEALING FURNACE

[75] Inventors: Masahiro Harada; Kenichi Yanagi; Takeo Fukushima, all of Hiroshima; Kusuo Furukawa, Chiba; Naohiko Soeda, Chiba; Norio Ohta, Chiba; Kuniaki Sato, Yotukaido; Yasuhisa Nakajima, Chiba, all of Japan

[73] Assignees: Mitsubishi Jukogyo Kabushiki Kaisha, Tokyo; Kawasaki Steel Corporation, Hyogo, both of Japan

[21] Appl. No.: 75,217

[22] Filed: Jul. 20, 1987

Related U.S. Application Data

[63] Continuation of Ser. No. 796,087, Nov. 8, 1985, abandoned.

[30] Foreign Application Priority Data

| | | | |
|---|---|---|---|
| Nov. 8, 1984 | [JP] | Japan | 59-234089 |
| Nov. 13, 1984 | [JP] | Japan | 59-237661 |
| Nov. 13, 1984 | [JP] | Japan | 59-237662 |
| Nov. 13, 1984 | [JP] | Japan | 59-237663 |
| Mar. 5, 1985 | [JP] | Japan | 60-41788 |

[51] Int. Cl.[4] ..... F27B 9/28

[52] U.S. Cl. ..... 432/8; 432/72; 432/59

[58] Field of Search ..... 432/215, 72, 8, 59; 266/102, 103

[56] References Cited

U.S. PATENT DOCUMENTS

| | | | |
|---|---|---|---|
| 3,186,694 | 6/1965 | Beggs | 432/8 |
| 3,604,824 | 9/1971 | Haridson | 432/72 |
| 3,917,444 | 11/1975 | Cantlew | 432/72 |
| 4,098,007 | 7/1978 | Davis et al. | 432/72 |
| 4,363,472 | 12/1982 | Shimoyama et al. | 266/102 |

FOREIGN PATENT DOCUMENTS

| | | | |
|---|---|---|---|
| 365570 | 7/1930 | United Kingdom | 432/215 |

*Primary Examiner*—Henry C. Yuen

*Attorney, Agent, or Firm*—Birch, Stewart, Kolasch & Birch

[57] ABSTRACT

The present invention relates to method and apparatus for heating a strip of metallic material in a continuous annealing furnace and more particularly to an improvement relating to a method and apparatus for heating a strip of metallic material in a continuous annealing furnace in which annealing of the strip is continuously carried out in such a manner that a gas, serving to adjust temperature of the strip, is blown toward the strip through a plurality of gas jet nozzles which are arranged on one side or both sides of the strip, wherein the temperature and flow rate of the strip are properly determined to a required level in response to the changing of the operating conditions such as the heat cycle, line speed, thickness of strip, width of strip and the like. Further, the present invention relates to a method and apparatus for heating a strip of metallic material in a continuous annealing furnace, wherein the temperature of the strip is controlled to reach a target temperature by heating or cooling the strip by means of a gas jet or the like having excellent respondency at a part of the heating zone in the continuous annealing furnace whereby irregular annealing of the strip is effectively inhibited.

5 Claims, 13 Drawing Sheets

METHOD AND APPARATUS FOR HEATING A STRIP OF METALLIC MATERIAL IN A CONTINUOUS ANNEALING FURNACE

This application is a continuation of application Ser. No. 796,087 filed on Nov. 8, 1985, now abandoned.

BACKGROUND OF THE INVENTION

1. Field of the Invention

The present invention relates to method and apparatus for heating a strip of metallic material in a continuous annealing furnace.

2. Related Art Statement

As shown in FIG. 8, a typical conventional continuous annealing furnace for continuously annealing a strip of metallic material such as a cold rolled steel sheet, tin plated steel sheet or the like is so constructed that the strip 1 is unreeled from a payoff reel and is then introduced into the furnace via a cleaning tank, looper or the like. The furnace is provided with a plurality of rolls (that are called helper rolls) R in both the upper and lower areas thereof and the strip 1 is subjected to heating or cooling at a temperature in the range of 650° C. to 900° C. dependency on the mechanical properties required for the strip product while it moves up and down in the vertical direction in the area as defined between the upper and lower rolls R. After completion of annealing, the strip acquires metallic properties such as high tensile strength, capability of deep drawing or the like at room temperature.

In recent years requirements have been raised from users for improving the method and apparatus for continuously annealing a strip of metallic material having different thicknesses and widths in accordance with different heat cycles in dependence upon the required mechanical properties of the strip product, because there is the tendency for carrying out production in many forms and small quantities. In the conventional furnace the strip 1 is heated up to an elevated temperature in the heating zone by thermal energy radiation in accordance with the radiant tube system. However, it is pointed out that the conventional furnace has the problem that the temperature of the strip to be heated can not be controlled quickly in response to variations of the heat cycle required for the strip, because the temperature of each of the radiant tubes has a large time constant. For instance, when the thickness of the strip 1 increases, that is, a strip having a thickness more than that of the preceding strip is continuously treated and therefore the thick strip having a large heat capacity moves through the heating zone, there is a necessity for raising the temperature of the radiant tubes to a higher level.

However, due to the fact that the radiant tubes themselves have large time constants in the range of 10 to 20 minutes, the strip 1 can not reach a predetermined temperature within a very short period of time after the intensity of combustion of the burners relative to the radiant tubes is changed.

In the meanwhile it is acceptable to change the line speed of the strip 1. When the line speed of the strip 1 is left unchanged until the preceding thin strip 1 moves past the heating zone of the furnace, it results that the front end part of the following thick strip is insufficiently heated. In practice, it was reported that a part of the strip having a very long length of 2000 to 5000 m was insufficiently annealed.

When the line speed of the following thick strip is reduced to a necessary extent in order to insure that it reaches the required temperature, it results the temperature of the strip is excessively increased and thereby it is annealed excessively. This leads to the production of a strip which has a softer mechanical property than generally required. Alternatively, when the line speed of the strip is changed to an intermediate level, it is found that the preceding strip becomes softened while a part of the following strip is insufficiently annealed.

On the contray, in the case where the thickness of a strip to be annealed decreases in the course of its moving through the heating zone in the furnace, it is obvious that a reverse phenomenon will be recognized to the foregoing case.

In the past users were generally willing to accept a strip product which was softened to a level above the required mechanical properties from the viewpoint of excellent workability. In recent years, however, automation has been increasingly employed for elastic working processes of metallic plates or like material and this leads to the tendency that metallic material softened in the above-described manner is not always willingly received by users. Thus, products which are uniformly treated have become increasingly important for users. However, this causes the joined area where two strips having different thickness are joined to one another to be subjected to irregular treating for a considerably long distance. Therefore, the conventional annealing method can not be employed. To obviate the above-mentioned problem concerning the joined area where the thickness of the strips varies, a proposal was made that a dummy strip should be interposed between two strips to be annealed and the operating conditions of the furnace were changed accordingly during the movement of the dummy strip through the heating zone. As a result, however, it has been found that the furnace has a reduced treating capability. In the meantime, it is necessary that a large quantity of strips having the same size or material must be continuously annealed in order to operate of the furnace at high efficiency. This leads to the necessity that a large quantity of strips must be kept in storage as inventory in an area located in close proximity to the continuous annealing furnace in order to facilitate the operation of the furnace as planned. As a result, the inventory cost increases and moreover production can not be carried out in the required acceptable timing relation.

Further, in the case where a thick strip is shifted to a thin strip in the course of the annealing operation or in the case where thin strip is shifted to a thick strip in the reverse manner, there occurs the following problem, particularly where differences in thickness between adjacent strips is remarkably large. For instance, in the case where a thin strip is shifted to a thick strip, gas having a higher temperature is blown toward the moving strip through gas jet nozzles which are exposed to radiant tubes having lower temperature immediately after the shifting of the thickness is effected in this way. As a result, a high intensity of thermal stress is generated in the gas jet nozzles and this leads to a fear of causing deformation, damage or the like with the gas jet nozzles.

Generally, the conventional continuous annealing furnace employed for continuously annealing a strip of metallic material is so constructed that the preheating zone, heating zone, soaking zone and cooling zone (inclusive excessive aging zone in the case where an excessive aging treatment is required for the strip) are arranged one after another as seen from the inlet side of the furnace. Heating in the preheating zone is achieved by direct heating with the use of exhaust gas which is delivered from the heating zone and the soaking zone or by blowing hot air toward the strip to raise it up to an elevated level by heat exchanging with the exhaust gas. Further, heating in the heating zone as well as in the soaking zone is achieved by means of a plurality of radiant tubes. On the other hand, cooling in the cooling zone is achieved in accordance with a roll cooling system, a gas jet cooling system or a cooling tube system. In the meanwhile, the temperature of the strip at the outlet of the heating zone is controlled to reach a target temperature by controlling the line speed in such a manner that the value of (thickness of strip)×(line speed) is kept constant while the temperature of the heating zone is left unchanged, and when the thickness of a strip is changed to another thickness with the same heat cycle being used during the whole operation. In the case where the existing heat cycle is changed to another one, the temperature of the strip at the outlet of the heating zone is controlled by changing the preset temperature in the heating zone.

However, it was found that the conventional continuous annealing furnace has the drawback that the heating zone has slow heat responsibility relative to the temperature thereof and it takes 20 to 30 minutes when the preset temperature of the heating zone is changed to another one and thus there appears to be a difference in temperature, for instance, 100° C. Accordingly, a material rejection, equivalent to the length of about one coil takes place due to insifficient heating, for instance, when the line speed is held at a level of 300 mpm. This means that there is a necessity for preparing a dummy coil having the length as mentioned above. However, a period of time in which the dummy coil moves past the heating zone in the furnace does not make a contribution to production and moreover using the dummy coil is not preferable from the viewpoint of saving thermal energy. Further, when such a dummy coil is used in the furnace, extra operations such as welding of the dummy coil before it enters the heating zone, cutting the dummy coil after it leaves and handling of the dummy coil in the area extending from the inlet to the outlet of the heating zone is necessary.

Another drawback of the conventional continuous annealing furnace is that when the thickness of the strip is changed to another thickness with the same heat cycle being employed material rejection takes place in the area located in front of and behind the weld point of the strip, because another line speed can not be quickly determined in response to a change in the thickness of the strip. To obviate the above-mentioned drawback, the temperature of the strip at the outlet of the heating zone is kept within the allowable temperature by limiting the amount the thickness of strip is changed to, for instance, within ±15% of the thickness of the preceding strip, whereby rejection due to material failure is inhibited. However, such a countermeasure as mentioned above makes it complicated to design an operation schedule relative to a strip to be annealed and to control the number of coils in a coil storage house.

SUMMARY OF THE INVENTION

Thus, the present invention has been made with the foregoing background in mind.

(I) It is an object of the present invention to provide a method of heating a strip of metallic material in a continuous annealing furnace with the aid of radiation of thermal energy from a plurality of radiant tubes which assures that the temperature can be quickly changed for the strip when operating conditions such as heat cycle, line speed or the like are changed.

(II) It is other object of the present invention to provide a method of heating a strip of metallic material in a continuous annealing furnace with the aid of radiation of thermal energy from a plurality of radiant heat tubes which assures that temperature response time in the heating zone is shortened when operating conditions such as heat cycle, thicknes of strip or the like are changed and a plurality of gas jet nozzles are inhibited from being subjected to a high intensity thermal stress at that time.

(III) It is another object of the present invention to provide an apparatus for heating a strip of metallic material in a continuous annealing furnace which assures that the temperature of the strip is quickly raised or lowered to a level of the target temperature to effectively heat or cool the strip without any necessity for complicated operations and utilization of a dummy coil as seen with the conventional furnace.

To accomplish the above objects there are proposed according to the present invention the following method and apparatus for heating a strip in a continuous annealing furnace.

(I) The present invention consists in that a gas of in which the temperature and flow rate can be adjusted as required, is blown toward the strip to be annealed on the one side or both sides of the strip for a short period of time whereby the temperature of the strip is spontaneously changed to reduce the time constant of the heating zone. Namely, there is proposed according to one aspect of the present invention a method of heating a strip of metallic material which is characterized in that a plurality of gas jet nozzles are arranged on one side or both sides of the strips in the heating zone which is operated with a radiant tube system and a gas with a temperature and flow rate which can be adjusted, as required, is blown toward the strip through the gas jet nozzles.

(II) In the present invention the gas which can be adjusted in temperature and flow rate, as required, is blown toward the strip to be annealed for a short period of time from area defined between the adjacent radiant tubes, whereby the temperature of the strip is spontaneously changed to reduce the time constant of the heating zone. Namely, there is proposed according to other aspect of the present invention a method of heating a strip of metallic material in a continuous annealing furnace which is characterized in that atmospheric gas, of which the temperature and flow rate can be adjusted as required, is blown toward the strip for a short period of time from the area defined between the adjacent radiant tubes in the heating zone which is operated in accordance with a radiant tube system.

(III) The present invention consists in that the intensity of combustion of the plurality of radiant tubes is changed before the operating conditions, such as the heat cycle, thickness of strip or the like are changed and at the same time, the flow rate of the gas to be blown through a plurality of gas jet nozzles is gradually changed. Namely, there is proposed according to another aspect of the present invention a method of heating a strip of metallic material in a continuous annealing furnace which is characterized in that a gas jet nozzle is arranged between adjacent radiant tubes in order to blow gas toward the strip through the gas jet nozzles in which the temperature and flow rate can be adjusted as required, for example, in the case where the thickness of the strip increases and therefore the amount of thermal energy to be applied to the strip is required to be increased, the intensity of combustion in the radiant tube burners must be increased before a required amount of thermal energy increases (in this case, before the thickness of the strip is changed). At the same time the amount of gas to be blown through the gas jet nozzle, which temperature is higher than that of the strip, is gradually increased to cool the strip until the amount of thermal energy increases to a required level. In the case where the thickness of the strip decreases and thereby the amount of thermal energy to be applied to the strip is required to be decreased, the intensity of combustion in the radiant tube burners is lowered before a required amount of thermal energy decreases (in this case, before thickness of the strip is changed). At the same time, an amount of gas to be blown through the gas jet nozzles in which the temperature is determined higher to be than that of the strip is gradually increased to heat the strip until the amount of thermal energy decreases to a required level.

The present invention will now be described in more detail below as to continuous heating means required in the case where a thin strip is shifted to a thick strip. According to the present invention, an intensity of combustion in the radiant tube burners is quickly raised up to a level corresponding to that to be used for the thick strip, before shifting to the thick strip is effected. It should be noted that a quick temperature increase does not occur due to the fact that the radiant tubes themselves have a large heat capacity but rather the amount of thermal energy required for a thin strip becomes large gradually. For this reason it is necessary that the amount of thermal energy which becomes large gradually is removed at the same time when an intensity of combustion in the radiant tube burners is increased. To this end an amount of cooling gas is gradually increased so that it is blown toward the strip. Blowing of cooling gas is interrupted when the thickness of the strip to be annealed is changed. Since the present invention consists of gradually blowing the gas through the gas jet nozzles, the occurrence of thermal stress due to gas blown through the gas jet nozzles is effectively inhibited. Thus, the period of response time in the heating zone can be shortened when the thickness of strip is changed.

(IV) Further, there is proposed, according to another aspect to the present invention, a method of heating a strip of metallic material in a continuous annealing furnace which is characterized in that the strip is heated or cooled by means of a gas jet having excellent thermal respondency in a part of the heating zone in the furnace in response to changing operating conditions such as the heat cycle, line speed, thickness of strip or the like whereby the heating temperature of the strip is controlled to reach a target temperature.

(V) Further, there is proposed according to another aspect of the present invention an apparatus for heating a strip of metallic material in a continuous annealing furnace which is characterized in that it includes a strip temperature controlling zone in a part of the heating zone and the strip temperature controlling zone is provided with means for heating or cooling the strip by using gas jets having excellent thermal respondency.

According to the present invention as defined in the preceding paragraphs (IV) and (V), the continuous annealing furnace is provided with a strip temperature controlling zone located in a part of the heating zone where heating is effected in accordance with a radiant tube system and whereby the temperature of a strip to be annealed can be controlled to reach to a target level by blowing heating or cooling gas directly toward the strip to quickly raise or lower the existing temperature. Thus, operation of the furnace is carried out properly without any complicated handling as well as without the utilization of a dummy coil.

By the way, the amount of thermal energy $Q_s$ received on or radiated from a strip to be annealed can be obtained in accordance with the following formulas for the case where heating or cooling is effected with the aid of radiant tubes, gas jets or rolls.

(1) In the case where heating or cooling is effected with the use of a plurality of radiant tubes $$Q_s = 4.88 \times \phi_{cq}\left\{\left(\frac{T_f + 273}{100}\right)^4 - \left(\frac{T_s + 273}{100}\right)^4\right\}$$

where $\phi_{cq}$: total thermal conductive coefficient $T_f$: furnace temperature (particularly, furnace wall temperature which is affected by temperature of radiant tubes)

$T_s$: temperature of the strip to be annealed (2) In the case where heating or cooling is effected by means of gas jets $$Q_s = KVn(T_g - T_s) \quad (2)$$

where

K: constant

V: flow speed of gas n: constant $T_g$: temperature of gas (3) In the case where heating or cooling is effected with the use of a plurality of rolls $$Q_s = \alpha t(T_R - T_s) \quad (3)$$

where

α: constant t: period of time for which strip to be annealed comes in contact with rolls under the influence of winding angle and the number of rolls $T_R$: temperature on the surface of rolls When an amount of thermal energy $Q_s$ received on the strip to be annealed is changed, that is, when the heat cycle and thickness of the strip LS are changed, there is the necessary for changing the furnace temperature $T_f$ in the case where heating is effected with the use of radiant tubes. However, due to the fact that the furnace wall and radiant tubes have large thermal capacity, it can not be expected that the furnace temperature $T_f$ is quickly changed.

However, in the case where heating or cooling is effected by means of a gas jet, the amount of thermal energy received on a strip to be annealed can be easily and quickly changed by changing the flow speed of the gas. Further, in the case where heating or cooling is effected by means of rolls, the amount of thermal energy received on a strip to be annealed can be easily and quickly changed by the changing winding angle of rolls relative to the strip, and the number of rolls about which the strip is wound, that is, the period of time for which the strip comes in contact with the rolls.

As the means for changing the flow speed of a gas jet, it is recommended to employ a damper to adjust the flow rate of the gas jet. Further, in the case where a plurality of rolls are employed for the purpose of heating or cooling, it is recommended to use driving rolls which are able to carry out thrusting, relative to the strip.

(VI) In the present invention a plurality of gas jet means blows gas toward a strip to be annealed at a temperature required to adjust the temperature of the strip. The gas jet means are arranged at a position located adjacent to the radiant tubes in the area extending from the rear part of the heating zone to the rearmost end of the same. Namely, there is proposed, according to a further aspect of the present invention, an apparatus for heating a strip of metallic material in a continuous annealing furnace which is characterized in that the annealing of the strip is continously carried out in such a manner that the front end part of the gas jet means, through which gas passes for adjusting the temperature of the strip, is located at the front end of the rear part of the heating zone. In response to the variation of thermal load in the range of 20 to 30%, the temperature and flow rate of the gas is adjusted to a required level in response to changing of the operating conditions such as the heat cycle, line speed, thickness of the strip or the like, and the rear end part of the gas jet means is extended to the furthermost end of the heating zone or over the entire soaking zone.

When a strip having different thicknesses over its entire length thereof is introduced into the continuous annealing furnace of the present invention, an intensity of combustion in the radiant tube burners is adjusted properly and the gas, having a temperature at a required level to adjust the temperature of the strip, is blown toward the strip through a plurality of gas jet means for a short period of time. Owing to such an arrangement it is insured that a quick temperature control is achieved while compensating for low temperature respondency of the radiant tubes. Further, since the gas jet means are arranged in the area extending from the rear part of the heating zone to the furthermost end of the same, proper temperature control can be achieved from the leading end of the strip while the preceding heat cycle is shifted to another heating cycle.

Finally, advantageous features of the present invention will be described below.

(I) As described above, the present invention consists in that gas, of which temperature and flow rate can be adjusted as required, is blown toward a strip of metallic material on one side or on both sides of the latter strip and that the gas of the above-mentioned type is blown toward the strip from an area between adjacent radiant tubes. Thus, proper heating can be carried out within a very short period of time in response to a change in the thickness of the strip or the like in the course of operating the furnace. As a result, a reduction in the yielding rate and an increased loss of products caused by changing the thickness of the strip can be effectively inhibited.

(II) The present invention consists in that the intensity of combustion in the radiant tubes can be changed before operating conditions such as the heat cycle, thickness of the strip or the like are changed and at the same time the flow rate of the gas blown through the gas jet nozzles can be gradually changed. Thus, for instance, temperature response time in the heating zone can be shortened when the thickness of the strip to be annealed is changed. This leads to the advantageous feature that the reduction of the yielding rate and increased loss of products caused by changing the thickness of the strip can be effectively inhibited. Another advantageous feature of the present invention is that deformation or damage does not take place due to thermal stress generated by the gas jet nozzles.

(III) Further, the present invention consists in that the heating zone is provided with a strip temperature controlling zone whereby temperature of the strip at the outlet of the heating zone can be easily controlled to reach a target level in response to a change in the heating curve, line speed or thickness of the strip. This leads to the advantageous features that there is no necessity for the use of complicated operations as are seen with the conventional furnace, and it becomes possible to widen the extent of deviation from a predetermined thickness of the strip, for instance, to ±50% and moreover the utilization of the dummay coil is not required.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENTS

Now, the present invention will be described in greater detail hereinunder with reference to the accompanying drawings which illustrate preferred embodiments thereof.

FIRST EMBODIMENT

Figure 1:
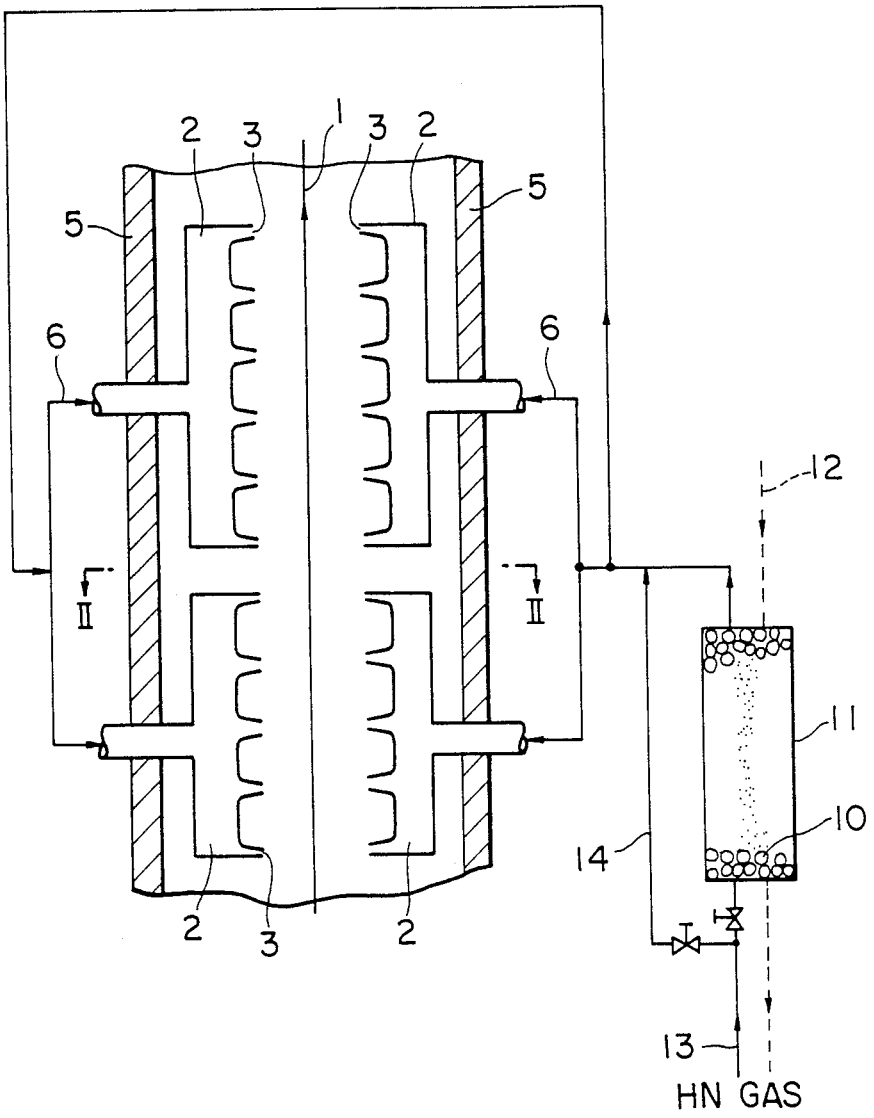
FIG. 1 is a fragmented schematic vertical, sectional view of a continuous annealing furnace to which the present invention is applied, particularly illustrating how the heating zone is constructed.

Description will now be made below as to the first embodiment of the present invention with reference to FIGS. 1 and 2. FIG. 1 is a fragmental schematic vertical sectional view of a heating furnace which is employed for carrying out the invention. The drawing shows the case where the heating furnace is provided with walls which are disposed on both the sides of a strip of metallic material (hereinafter referred to simply as a strip) to maintain it in a heated state. In the drawing reference numeral 1 designates the strip, reference numeral 2 is a plenum chamber, reference numeral 3 is a gas jet nozzle, reference numeral 5 is a furnace wall which is lined with thermal insulating material having a small heat capacity, such as a ceramic fiber or like material and reference numeral 6 is a gas feeding duct through which gas is introduced into the plenum chamber 2. Further, reference numeral 10 designates a pebble-shaped, heating storing medium (hereinafter referred to simply as pebble) made of material having a high melting temperature such as a ceramic or the like; reference numeral 11 is a filled structure which is filled with pebbles 10 (hereinafter referred to as a pebble heater); reference numeral 12 is a gas feeding duct through which hot gas having a temperature in the range of 1200° to 1300° C. is introduced into the pebble heater 11; reference numeral 13 is a HN gas feeding duct through which HN gas (a gas mixture of hydrogen and nitrogen) having a comparatively low temperature is introduced into the pebble heater 11 and reference numeral 14 is a bypass duct for HN gas. Hot gas is fed into the pebble heater 11 through the gas feeding duct from the top side of the pebble heater 11 and it is then discharged from the bottom of the heater. On the other hand, HN gas is fed into the pebble heater 11 through the feeding duct 13 from the bottom side of the pebble heater 11 and it is then delivered to the plenum chamber 2 from the top of the heater.

Figure 2:
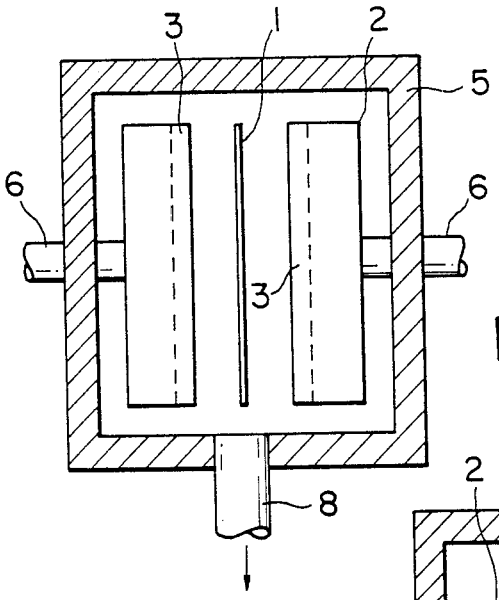
FIG. 2 is a cross-sectional view of the heating zone in the continuous annealing furnace, taken along line II—II of FIG. 1.

FIG. 2 is a cross-sectional view of the heating furnace taken along line II—II in FIG. 1. In the drawing reference numeral 8 designates a dischargig duct through which HN gas flowing out of the plenum chamber 2 is discharged to the outside. It should be noted that the discharged HN gas may be reused by being reintroduced to the HN gas feeding duct 13.

Figure 5:
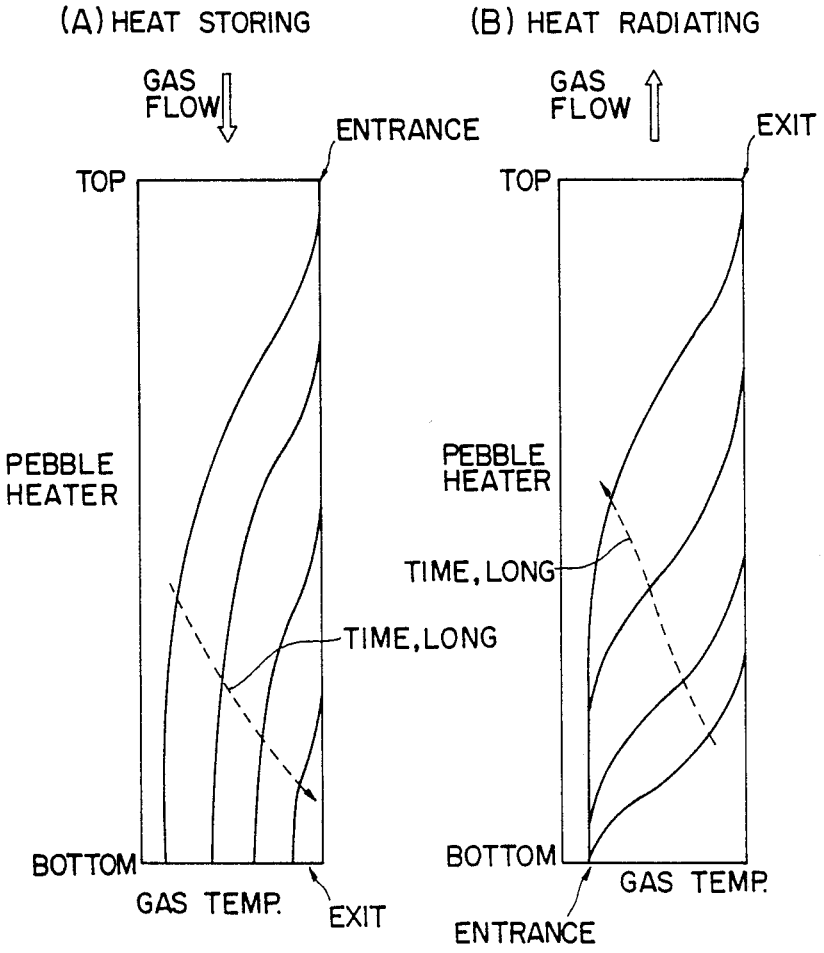
FIG. 5(A) is a schematic side view of a pebble heater used for the heating zone, particularly illustrating how the temperature varies during heat storing, with a passage of time.
FIG. 5(B) is a schematic side view of the pebble heater used for the heating zone similar to FIG. 5(A), particularly illustrating how the temperature varies during heat radiation with a passage of time.

Refering to FIG. 1 again, for instance, in the case where steady operation is performed for heating the strip 1 having the same thickness, heating is achieved merely by means of a plurality of radiant tubes in the heating zone located upstream or downstream of the furnace of the invention. When operating conditions such as the heat cycle, thickness of the strip, width of the strip, line speed or the like are caused to vary, for instance, when the following strip has an increased thickness compaired with the thickness of the preceding strip and thereby the intensity of heating is required to be increased, hot gas which is previously heated up to an elevated temperature in the range of 1200° to 1300° C. with the aid of a heater which is not shown in the drawings is first introduced into the pebble heater 11 during steady operation of the furnace as mentioned above. At this moment distribution of temperature of the pebbles 10 in the pebble heater 11 is as shown in FIG. 5(A). As is apparent from the drawing, the temperature of the pebbles 10 varies in such a manner that it becomes closer to the temperature of the gas during heat storing as time elapses. Thus, the temperature in the pebble heater 11 can be maintained at the level of the hot gas in that way. Next, the intensity of combustion in the radiant tube burners is caused to increase immediately after the strip 1 having an increased thickness enters the furnace. At the same time HN gas is supplied into the pebble heater 11 from the bottom side thereof through the duct 13. This causes the distribution of temperature in the pebble heater 11 to vary as shown in FIG. 5(B) which illustrates how temperature in the pebble heater 11 varies during heat radiation. As the HN gas having a lower temperature comes in contact with the hot pebbles 10 having a large heat capcity, temperature of HN gas increases rapidly. As a result, the gas temperature at the outlet of the pebble heater 11 is raised to the level of the maximum temperature (1200° to 1300° C.) of the pebble heater 11 within a period of several seconds and is fed into the plenum chamber 2 for 10 to 20 minutes until the temperature of the radiant tubes reaches a steady state whereby the temperature of the strip can be raised up to a predetermined temperature. Accordingly, jets of gas having a high temperature can be blown toward the strip 1 having an increased thickness in a very short period of time compaired with the number of radiant tubes immediately after the strip 1 undergoes an increased thickness. This means that the temperature of the strip 1 can be instantaneously raised to a predetermined level of temperature, resulting in the length of a part of the strip 1 where annealing is carried out insufficiently being remarkably reduced.

On the other hand, for instance, in the case where the thickness of the strip decreases, a part of the HN gas having a lower temperature near to room temperature is caused to bypass the heater so that it is mixed with the other part of the HN gas which has been heated to an elevated temperature. Thus, by properly adjusting the mixing ratio, a gas having a properly determined lower level of temperature can be supplied to the furnace within a period of several seconds in response of variation in the thickness of the strip.

The present invention has been described above with respect to the case where a vertically extending strip of metallic material is subjected to heating on both sides thereof. It should of course be understood that it should not be limited only to this case but it may be applied to the case where the furnace has a horizontally extending heating zone as well as the case where heating is achieved on only one side of the strip. Further, the present invention should not be limited to the case where the pebble heater (heat storing type heater with heat storing mediums filled therein) is employed for the furnace but also other kinds of means for adjusting the temperature of the gas and the flow rate thereof may be employed for the same purpose.

SECOND EMBODIMENT

Figure 3:
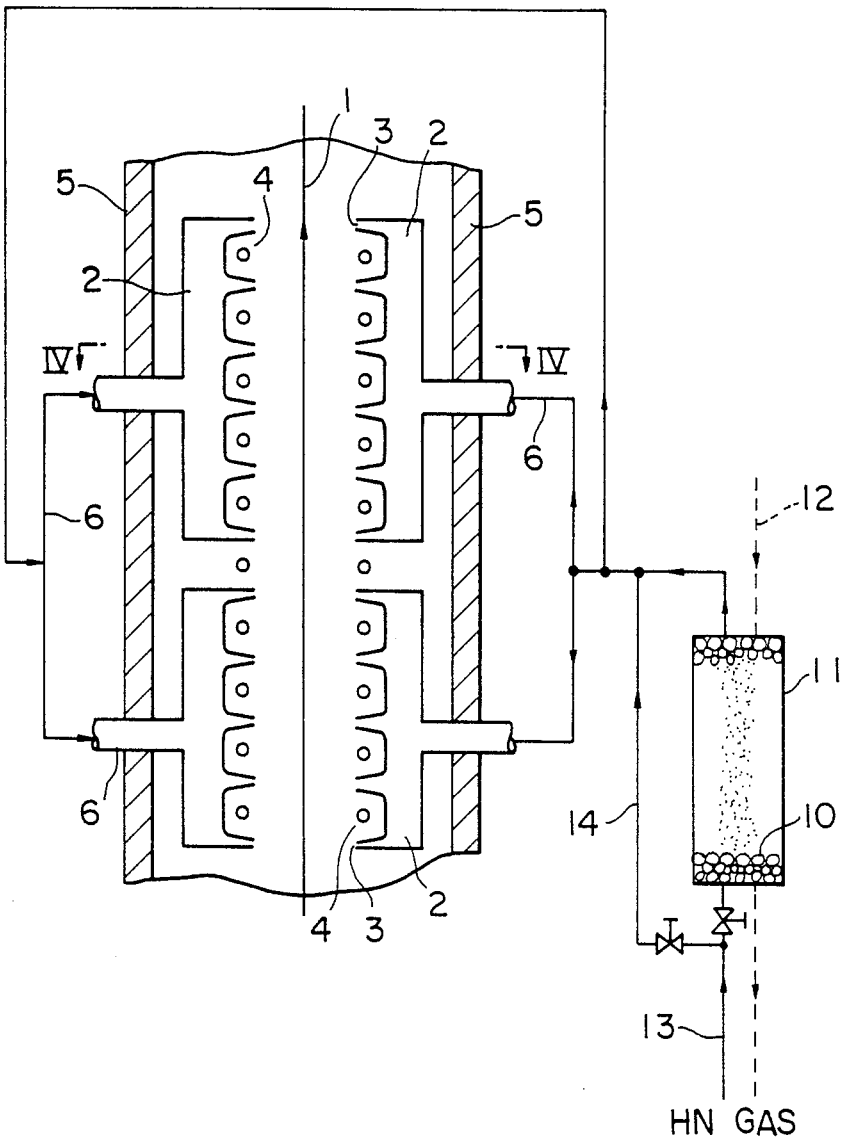
FIG. 3 is a fragmented schematic vertical, sectional view of a continuous annealing furnace similar to FIG. 1 in which another embodiment of the invention is carried out, particularly illustrating how the heating zone is constructed.

Next, description will be made below as to the second embodiment of the present invention with reference to FIGS. 3 and 4. FIG. 3 is a fragmental schematic vertical sectional view of a heating furnace which is employed for carrying out the invention. The drawing shows the case where heating is achieved by means of a plurality of radiant tubes from both the sides of the strip. In the drawings reference numeral 1 designates a strip of metallic material, reference numeral 2 is a plenum chamber, reference numeral 3 is a gas jet nozzle, reference numeral 4 is a radiant tube, reference numeral 5 is a furnace wall which is lined with thermal insulating material having a small heat capacity such as a ceramic fiber or the like and reference numeral 6 is a gas feeding duct through which gas is introduced into the plenum chamber 2. Further, reference numeral 10 designates a pebble-shaped heat storing medium (hereinafter referred to simply as pebble) made of material having a high melting temperature such as a ceramic or the like, reference numeral 11 is a filled structure which is filled with the pebbles 10 (hereinafter referred to as a pebble heater), reference numeral 12 is a gas feeding duct through which hot gas having a temperature in the range of 1200° to 1300° C. is introduced into the pebble heater 11, reference numeral 13 is a HN gas feeding duct through which HN gas (mixture gas of hydrogen and nitrogen) having a comparatively low temperature is introduced into the pebble heater and reference numeral 14 is a bypass duct for HN gas. Hot gas is fed into the pebble heater 11 through the gas feeding duct 12 from the top side of the pebble heater 11 and it is then discharged from the bottom of the same. On the other hand, HN gas is fed into the pebble heater 11 through the feeding duct 13 from the bottom side of the pebble heater 11 and it is then delivered to the plenum chamber 2 from the top of the same.

Figure 4:
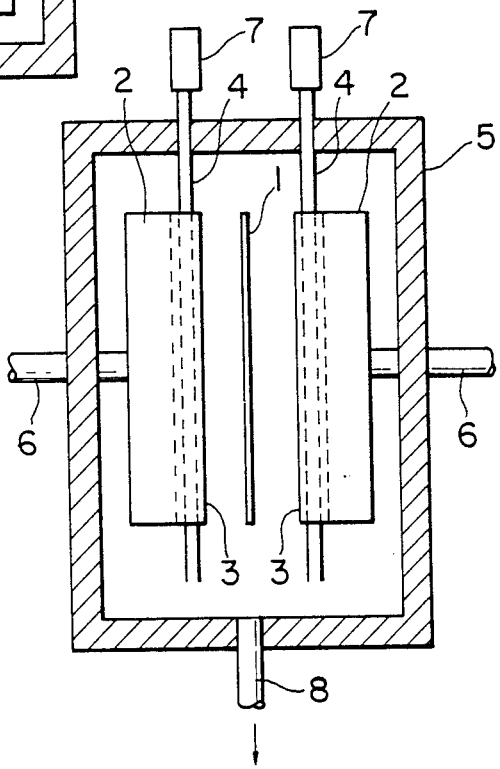
FIG. 4 is a cross-sectional view of the heating zone in the continuous annealing furnace similar to FIG. 2, taken along line IV—IV of FIG. 3.

FIG. 4 is a cross-sectional view of the heating furnace taken along line IV—IV of FIG. 3. In the drawing reference numeral 7 designates a combustion burner which is used exclusively for the radiant tube 4 and reference numeral 8 is a discharging duct through which HN gas flowing out of the plenum chanmber 2 is discharged to the outside. It should be noted that thus discharged HN gas may be reused by reintroducing it back to the HN gas feeding duct 13.

Refering to FIG. 3 again, for instance, in the case where steady operation is performed by heating the strip 1 having the same thickness, heating is achieved merely by means of a plurality of radiant tubes. When operating conditions such as the heat cycle, thickness of strip, width of strip, line speed or the like are caused to vary, for instance, when the following strip has an increased thickness compaired with the thickness of the preceding strip and thereby the intensity of heating is required to increased, hot gas which is previously heated up to an elevated temperature in the range of 1200° to 1300° C. with the aid of a heater which is not shown in the drawings is first introduced into the pebble heater 11 through the duct 12 during steady operation of the furnace as mentioned above. At this moment distribution of temperature of the pebble 10 in the pebble heater 11 is as shown in FIG. 5(A). As is apparent from the drawing, the temperature of the pebble 10 varies in such a manner that it comes closer to the temperature of the gas during heat storing, as time elaspes. Thus, the temperature in the pebble heater 11 can be maintained at a level of that of hot gas in this way. Next, the intensity of combustion of the radiant tube burners is caused to be increase immediately after the strip 1 having an increased thickness enters the furnace. At the same time HN gas is supplied into the pebble heater 11 from the bottom side thereof through the duct 13. This causes the distribution of the temperature in the pebble heater 11 to vary as shown in FIG. 5(B) which illustrates how the temperature in the pebble heater 11 varies during heat radiating. Since HN gas having a lower temperature is brought in contact with the hot pebbles 10 having large heat capacity, it results that the temperature of the HN gas increases rapidly. As a result, the temperature of the gas at the outlet of the pebble heater 11 is raised up to the level of the maximum temperature (1200° to 1300° C.) of the pebble heater 11 within a period of several seconds and can be fed into the plenum chamber 2 for 10 to 20 minutes until the temperature of the radiant tubes reach a steady state whereby the temperature of the strip can be raised up to a predetermined temperature. Accordingly, jets of gas having a high temperature can be blown toward the strip 1 having an increased thickness for a very short period of time compaired with the number of radiant tubes immediately after the strip 1 has had an increase in its thickness. This means that the temperature of the strip 1 can be instantaneously raised up to a predetermined level of temperature, resulting in the length of a part of the strip 1 where annealing is carried out sufficiently being remarkably reduced.

On the other hand, for instance, in the case where the thickness decreases, a part of HN gas having a lower temperature closer to room temperature is caused to bypass the heater so that it is mixed with the other part of HN gas which has been heated to an elevated temperature. Thus, by properly adjusting the mixing ratio a, gas having a properly determined lower level of temperature can be supplied to the furnace within a period of several seconds in response to a variation in the thickness of the strip.

The present invention has been described above with respect to the case where a vertically extending strip of metallic material is subjected to heating on both sides thereof. It should of course be understood that it should not be limited only to this situation but it may be also applied to the case where the furnace has a horizontally extending heating zone as well as the case where heating is generally carried out for a strip of metallic material in accordance with the radiant tube system. Further, the present invention should not be limited to the case where the pebble heater (heat storing type heater with heat storing medium filled therein) is employed for the furnace but also other kinds of means for adjusting the temperature of the gas and flow rate of the same may be employed for the same purpose.

THIRD EMBODIMENT

Further, the heating method as illustrated in FIG. 3 will be described in more details with reference to FIGS. 6(A) to (C) as well as FIGS. 7(A) to (C).

Figure 6A:
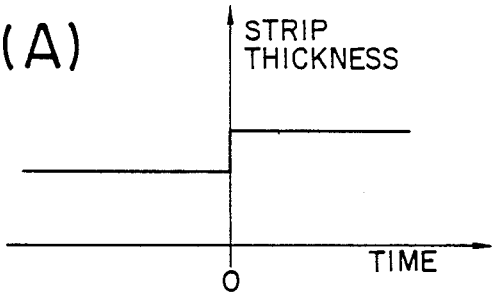
FIGS. 6(A) to (C) show the relation of the thickness of strip to be annealed vs. time when a thin strip is shifted to a thick strip.
Figure 6B:
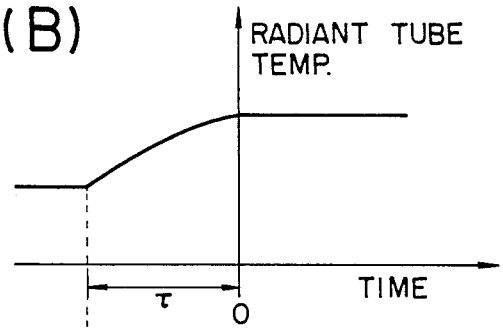
Figure 6C:
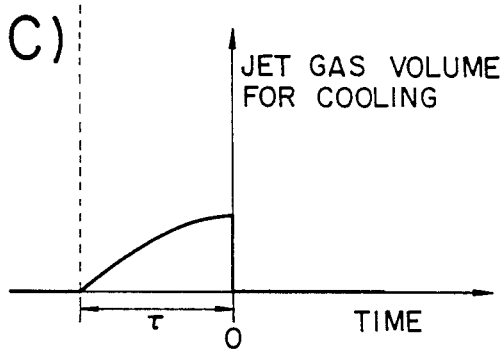

First, FIG. 6 shows the case where the thickness of the strip varies in such a manner that a thin strip is shifted to a thick strip. FIG. 6(A) illustrates how the thickness of the strip varies with time; FIG. 6(B) shows how temperature of the radiant tubes varies with time; and FIG. 6(C) shows how the flow rate of the cooling jet of gas varies as time elapses. As is apparent from FIG. 6(B), when the thin strip shifts to a thick one, the operation for raising the temperature of the radiant tubes is initiated at a time of about two hours before the shifting is to be effected. It should be noted that the temperature is gradually raised because the radiant tubes themselves have a large time constant. This causes the thin strip to be gradually subjected to excessive heating until the thickness shifting is completed. Thus, to assure that the thin strip maintains a proper temperature during heating, the flow rate of cooling gas jet is caused to gradually increase for the purpose of cooling it until the shaft in thickness takes place.

Figure 7A:
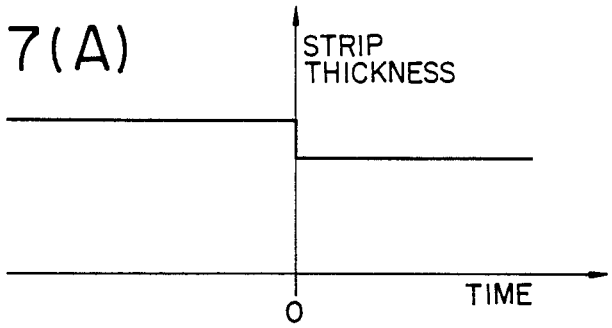
FIGS. 7(A) to (C) are similar to FIGS. (A) to (C), respectively, showing the relation of the thickness of the strip to be annealed vs. time when the thick strip is shifted to a thin strip.
Figure 7B:
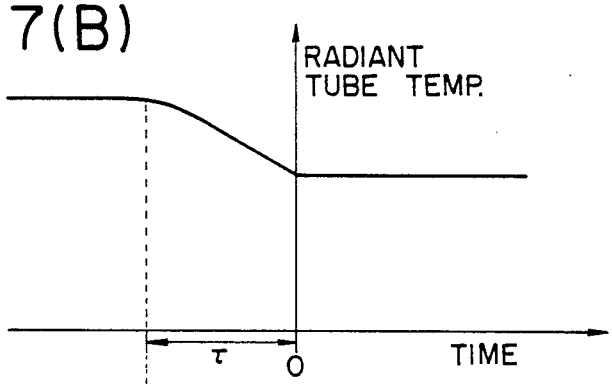
Figure 7C:
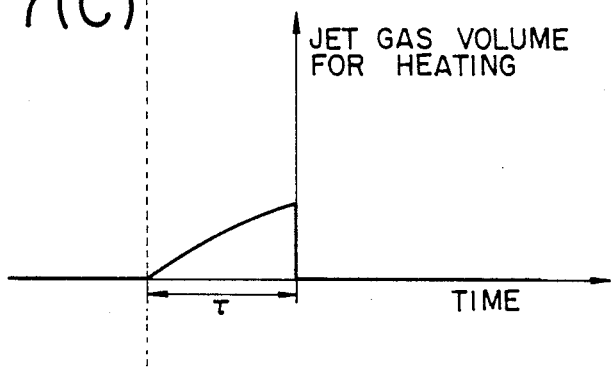
Figure 8:
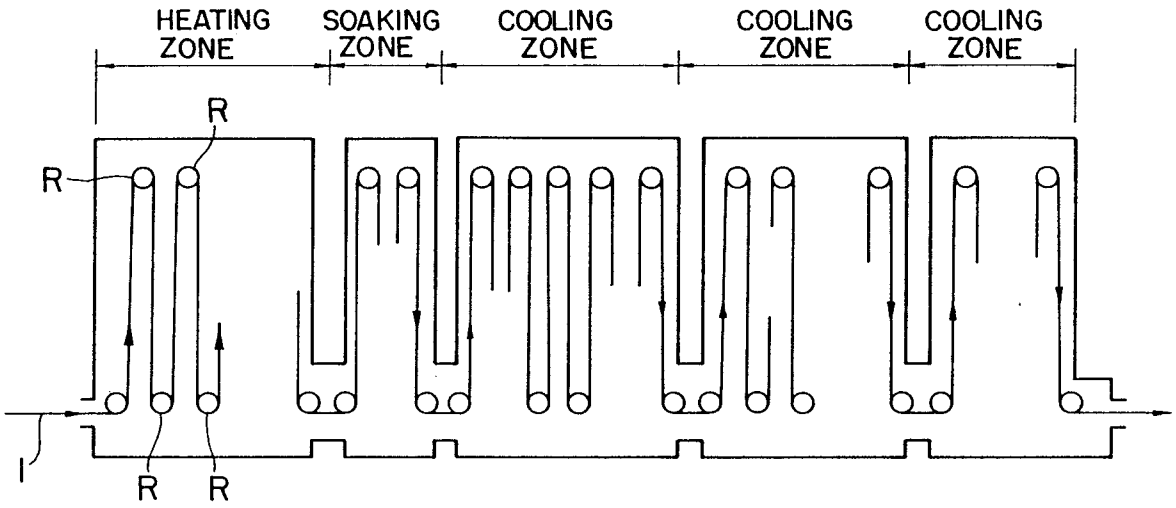
FIG. 8 is a schematic sectional side view of a conventional continuous annealing furnace.

Next, FIG. 7 shows the case where the thickness of the strip varies in such a manner that a thick strip is shifted to a thin strip, wherein FIG. 7(A) illustrates how the thickness of the strip varies as time elapses; FIG. 7(B) shows how temperature of the radiant tubes varies as time elapses and FIG. 7(C) shows how the flow rate of the jet of cooling gas varies as time elapses. As is apparent from FIG. 7(B), when the thick strip is to be shifted to a thin strip, operation the for lowering the temperature of the radiant tubes is initiated at time of about two hours before the shifting is effected. It should be noted that the temperature is gradually lowered because the radiant tubes themselves have a large time constant. This causes the thick strip to be gradually subjected to heating with a reduced amount of thermal energy until thickness shifting is completed. To compensate for the shortage of thermal energy, the flow rate of the gas, the temperature of which is determined to be higher than that of the strip is caused to be gradually increase and heating is effected for the strip with an increased flow rate of gas until the shaft in thickness takes place.

The present invention has been described above with respect to the case where a strip of metallic material is subjected to heating on both sides thereof with the aid of a number of radiant tubes which are arranged one above another in a vertically aligned relationship. It should of course be understood that it should not be limited only to this situation but may also be applied to the case where a furnace has a heating zone having the trapezoidal configuration as seen from the side as well as the case where the heating is generally carried out for a strip of metallic material in accordance with the conventional radiant tube system. Further, the present invention should not be limited to the case where the pebble heater (heat storing type heater with heat storing medium filled therein) is employed for the furnace but other kinds of means for adjusting the temperature of the gas and the flow rate of the same may be employed for the same purpose.

FOURTH EMBODIMENT

Figure 9:
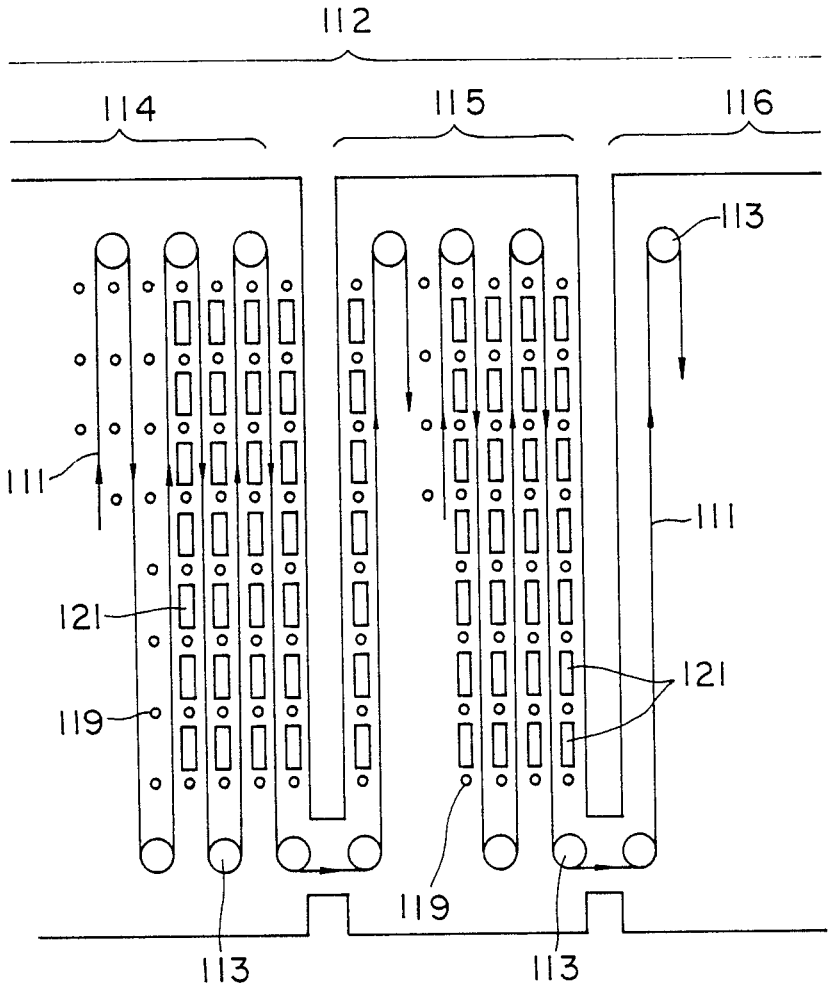
FIG. 9 is a fragmental schematic vertical side view of the continuous annealing furnace in accordance with an embodiment of the present invention, particularly showing an essential part in the furnace.

FIG. 9 is a schematic vertical sectional side view of an essential part in the continuous annealing furnace in accordance with the fourth embodiment of the present invention.

As shown in FIG. 9, the furnace includes a plurality of heating zones comprising a heating zone 114 and a soaking zone 115. As is apparent from the drawing, a number of plenum chambers 121 serving as gas jet means are arranged in the spaced relation with a number of radiant tubes 119 located in the proximity of the the plenum chambers 121 in the area extending from the rear part of the heating zone 114 to the furthermost end of the soaking zone 115, that is, over the area including the rear part of the heating zone 114 and the whole soaking zone 115.

In this embodiment, for instance, when a strip 111 which has an increased thickness for the purpose of increasing the production rate is supplied to the continuous annealing furnace 112, the intensity of combustion of the burners for the radiant tubes 119 in both the heating zone 114 and the soaking zone 115 is raised up and HN gas which is heated to a required elevated temperature with the aid of the gas jet means is blown toward the moving strip 111 until the temperature of the radiant tubes 119 reaches a required high level. As a result, the strip 111 is heated up to a required level of temperature without any time delay. It should be noted that since the gas jet means are arranged over the area including the rear part of the heating zone 114 and the entire soaking zone 115, the strip 111, the thickness of which is changed in response to a change in the production rate can be controlled to maintain a proper temperature, starting with the foremost end part of the strip 111. If gas jet means are arranged only in the intermediate part of the heating zone, variation of temperature of the radiant tubes 119 located behind the gas jet means as seen in the direction of movement of the strip 111 is caused to be delayed whereby the foremost end part of the strip 111 leaves the heating zone before it reaches the predetermined level of temperature.

In view of the above-mentioned fact the scope of the area at the front end part of the heating zone where the gas jet means are arranged should be determined in dependence on the extent of fluctuation of the thermal load (normally about 20%) corresponding to the fluctuation in the amount of thermal load which is obtainable by composite multiplication of the heat cycle or line speed of the strip 111 to be annealed and thickness of the strip and temperature difference equivalent to the extent of increasing the temperature of the strip. It is preferable that the gas jet means are arranged in the area extending from the position where the amount of thermal load on the strip 111 is reduced by 20 to 30% in the heating zone 114 to the rearmost end position of the latter. If the area where the gas jet means are arranged is determined to be small, there is a fear of causing such a malfunction that the srtip 111 to be annealed is heated higher than the predetermined annealing temperature before it reaches the area where they are arranged, that is, a so-called superheating, for instance, when the strip has a reduced thickness.

Figure 10A:
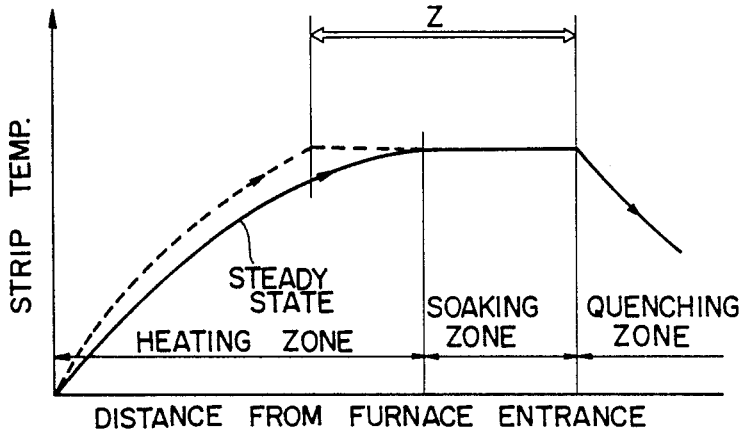
FIGS. 10(A) and (B) are graphs which respectively show the relation of temperature of the strip vs. distance from the furnace inlet in a continuous annealing furnace including a heating zone, soaking zone and quenching zone.
Figure 10B:
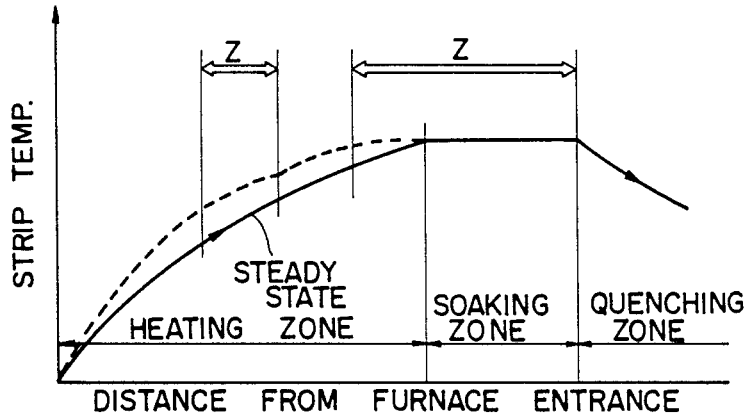

FIG. 10(A) illustrates how the temperature of the strip to be annealed varies in the furnace as constructed in accordance with this embodiment. As is apparent from the drawing, the temperature of the strip is raised up at a higher rate than in the case of the normal operating state as represented by a dotted line, for instance, when the thickness of the strip is reduced and thereby the amount of thermal load decreases. However, when it reaches the area Z where the gas jet means are arranged, it is restrained within the predetermined level of temperature. Next, FIG. 10(B) illustrates how the temperature of the strip to be annealed varies in the furnace as constructed in accordance with a modified embodiment of the invention where the area Z where the gas jet means are arranged is divided into two sections. In this embodiment the gas jet means are additionally arranged in the intermediate area of the heating zone 114.

Figure 11A:
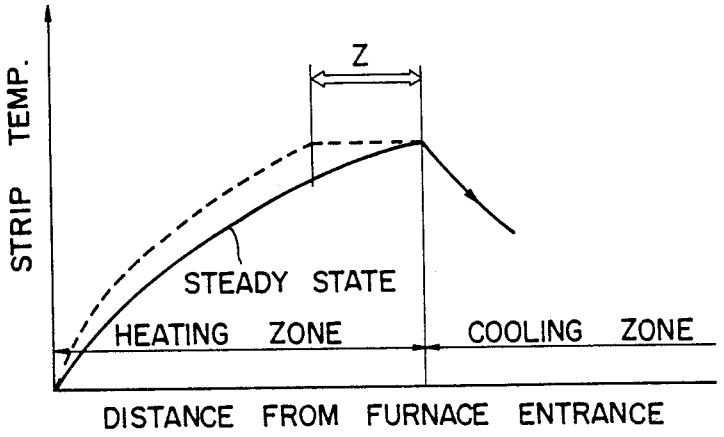
FIGS. 11(A) and (B) are graphs similar to FIGS. 10(A) and (B), respectively, which shows the relation of the temperature of the strip vs. the distance from furnace inlet in the continuous annealing furnace of the type including a no soaking zone.
Figure 11B:
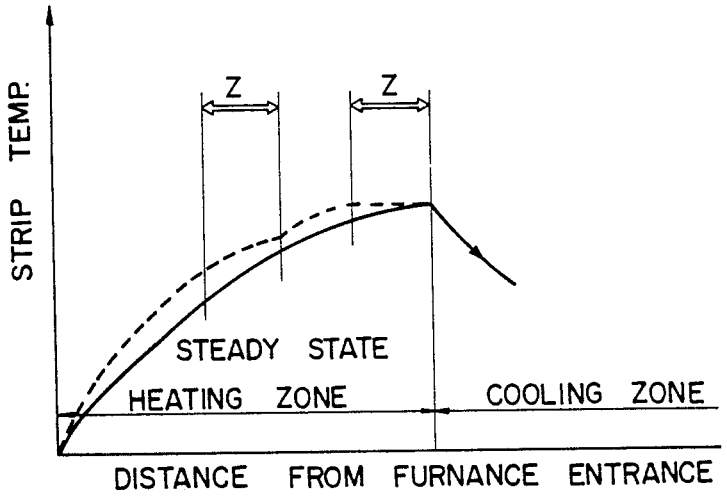

Next, FIGS. 11(A) and (B) are a graphs similar to FIGS. 10(A) and (B) respectively which show the case where the present invention is applied to a continuous annealing furnace which is not provided with the soaking zone 115 shown in FIG. 9. Obviously, in the continuous annealing furnace which is not provided with the soaking zone 115, a heating area is constituted merely by the heating zone 114. Accordingly, gas jet means are arranged in the area located at the rear part of the heating zone 114.

The present invention has been described above with respect to the case where thickness of the strip 111 is reduced and an amount of thermal load decreases. When thickness of the strip, width of the same and line speed increase and thereby an amount of thermal load is caused to increase, HN gas comprising a mixture gas having a required high temperature is introduced into the plenum chambers 121 whereby the strip 111 can maintain a required high annealing temperature for a period of time until the temperature generated by means of the radiant tubes 119 is raised up to a required high level of temperature.

FIFTH EMBODIMENT

Figure 12:
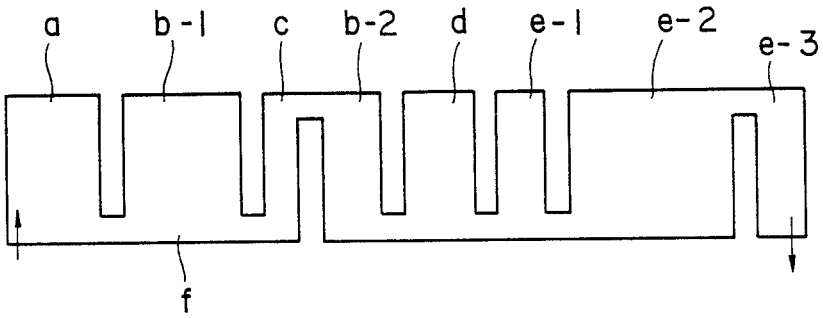
FIG. 12 is a schematic vertical sectional view of the continuous annealing furnace of the present invention.

FIG. 12 schematically illustrates how a continuous anealing furnace f is constructed in accordance with the fifth embodiment of the invention. In this embodiment the furnace includes a preheating zone a, heating zones b-1 and b-2, a soaking zone d and cooling zones e-1, e-2 and e-3. A strip temperature controlling zone c is constituted as a part of the heating zone b and includes a cooling zone which is operated in accordance with the gas jet system. It is preferable that heating and cooling means for the strip temperature control zone c is constructed in such a system that it has quick response time and temperature of the strip can be easily controlled. A method of carrying out heating so that the cooling with the aid of gas jets or rolls may be employed as the system as mentioned above. In the illustrated embodiment the method of carrying out heating and cooling with the aid of gas jets is employed. Specifically, the function of the strip temperature controlling zone is to lower the existing temperature of the strip which has been excessively heated or to raise the existing temperature of the strip which has been insufficiently heated when the heat cycle, line speed, thickness of the strip or like factors have been changed. Thus, the temperature of the strip at the outlet of the heating zone can be maintained at an intended level of temperature.

Figure 13:
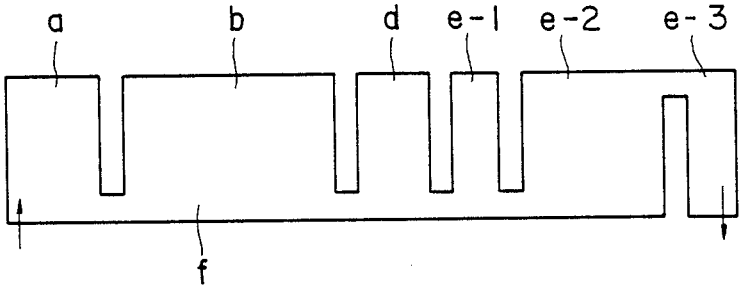
FIG. 13 is a schematic vertical sectional view of a conventional continuous annealing furnace similar to FIG. 12.
Figure 14:
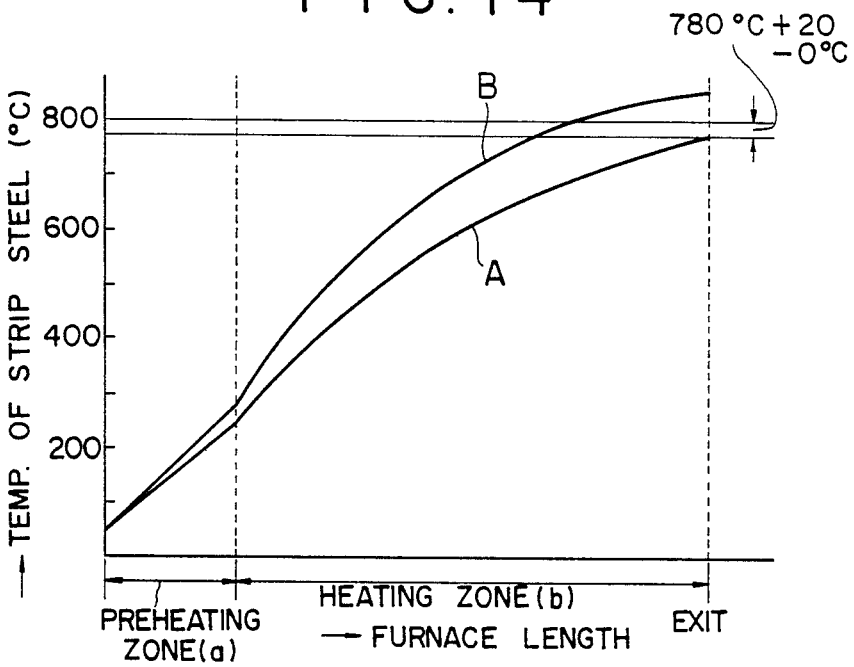
FIG. 14 is a graph including heat curves for a strip of metallic material in the area extending from the inlet of the preheating zone to the outlet of the heating zone in a conventional continuous annealing furnace, particularly showing the relation of temperature of the strip vs. the distance from the furnace inlet.

FIG. 13 schematically illustrates how the conventional continuous annealing furnace is constructed for steel strips which are subjected to rolling at a lower temperature and FIG. 14 shows heat curves which extend from the preheating zone to the outlet of the heating zone in the conventional continuous annealing furnace. In FIG. 14 reference letter A designates a heat curve which was obtained when a strip of cold rolled steel having a thickness of 0.1 mm and a width of 1200 mm is annealed at a line speed of 300 mpm, whereas reference letter B shows a heat curve which was obtained when a strip of cold rolled steel having a thickness of 0.75 mm and a width of 1200 mm is annealed at a line speed of 300 mpm.

As is readily apparent from a comparison between curves A and B for cold rolled steel strip which were obtained by operating the conventional continuous annealing furnace, there occurs a temperature difference of about 70° C. at the outlet of the heating zone when both the cold rolled steel strips A and B are annealed at the same line speed and the cold rolled steel strip B is excessively heated by 50° C. relative to a target temperature of strip of 780° C.±20°C.

Figure 15:
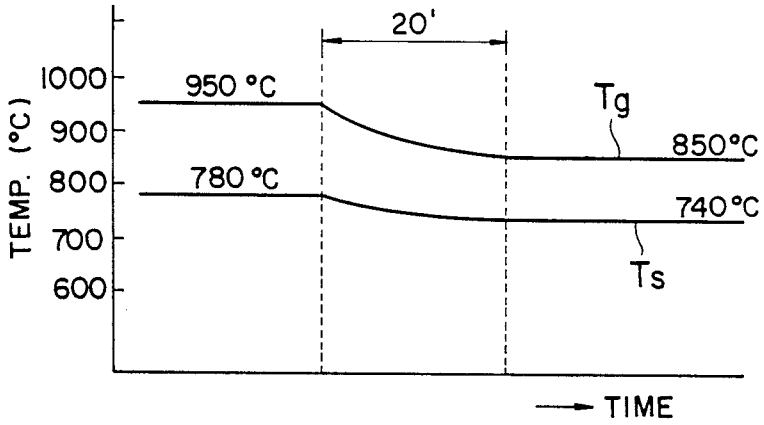
FIG. 15 is the graph showing a relation of temperature of the strip vs. time in the area extending to the outlet of the heating zone in a conventional continuous annealing furnace.

Further, FIG. 15 illustrates how strip temperature $T_s$ at the outlet of the heating zone varies when preset temperature $T_g$ in the heating zone of the conventional annealing furnace is changed from 950° C. to 850° C. The drawing shows that about 20 minutes is required for the temperature $T_g$ to reach 850° C. and similarly about 20 minutes is required for the temperature $T_s$ to be lowered from 780° C. to the target temperature of 740° C.±20°.

Figure 16:
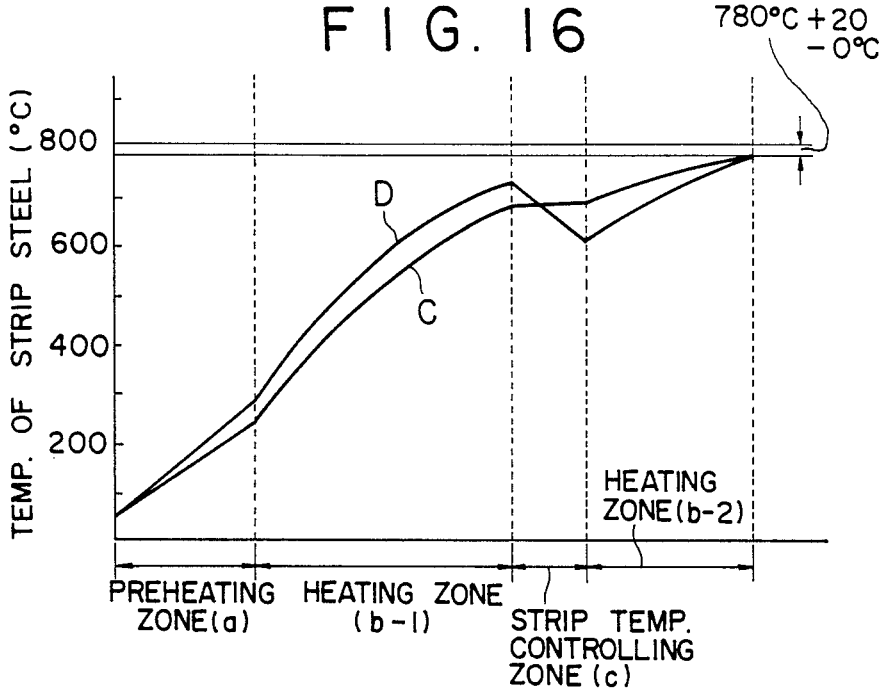
FIG. 16 is a graph including heat curves for a strip of metallic material in the area extending from the inlet of preheating zone to outlet of heating zone in the continuous annealing furnace of the invention similar to FIG. 14, particularly showing the relation of temperature of the strip vs. distance from the furnace inlet.

Next, FIG. 16 shows heat curves which are obtainable when the method of the present invention is employed. In the drawing, reference letter C designates a heat curve which was obtained in the same manner as in the case of the heat curve A when a strip of cold rolled steel having a thickness of 1.0 mm and a width of 1200 mm is annealed at a line speed of 300 mpm, whereas reference letter D shows a heat curve in the same manner as in the case of the heat curve B when a strip of cold rolled steel having a thickness of 0.75 mm and a width of 1200 mm is annealed at a line speed of 300 mpm. A target temperature of 780° C. can be reached at the outlet of the heating zone by lowering the temperature of cold rolled steel D to 610° C. in the strip temperature controlling zone c. Further, when the line speed x is changed to $1.0t \times 300$ mpm$-0.75x$ mpm after the welded point of the strip moves past the heating zone, the heat curve which is scribed thereafter becomes the same as that in the case of the cold rolled steel strip.

Figure 17:
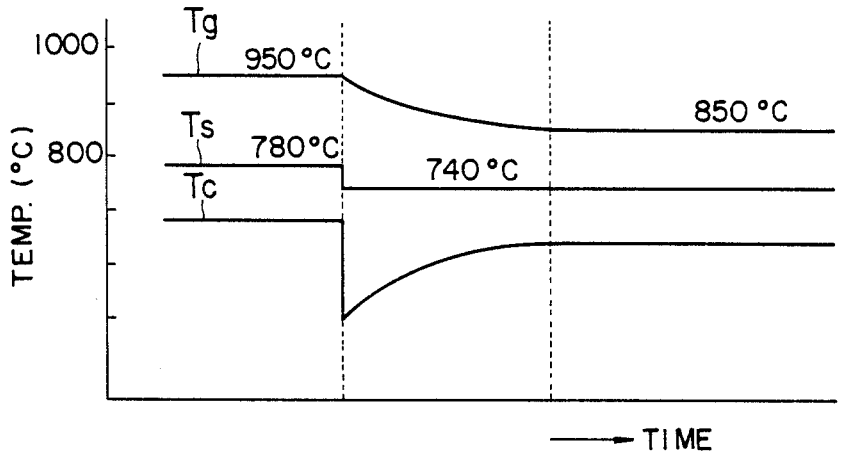
FIG. 17 is the graph showing a relation of temperature of the strip vs. time in the continuous annealing furnace of the invention similar to FIG. 15.

Next, FIG. 17 is a graph which illustrates how the preset temperature $T_g$ at the heating zone varies when it is changed from 950° C. to 850° C. In the drawing reference letters $T_s$ designates the temperature of the strip at the outlet of the heating zone which is controlled in accordance with the method of the present invention, whereas reference letters $T_c$ shows the temperature of the strip at the outlet of the strip temperature controlling zone. Similarly to the conventional method, it takes about 20 minutes until the temperature of the strip at the heating zone is lowered from 950° C. to 850° C. but the temperature of the strip $T_s$ at the outlet of the heating zone can be controlled to the target temperature level by controlling the temperature of the strip $T_c$ at the outlet of the strip temperature controlling zone. Incidentally, feedback controllling for which a strip temperature measuring meter is used at the outlet of the heating zone is employed as a method of the controlling temperature of the strip.

The function of the controlling zone has been described above with respect to the case where the preset temperature of the strip at the heating zone is changed to the lower side but controlling can be effected in the same manner as in the foregoing case and also in the case where it is changed to the higher temperature side.

While several preferred embodiments of the present invention has been described fully hereinabove, it should be understood that the present invention is not intended to be restricted to the details of the specific constructions shown in the preferred embodiments, but to the contrary, various changes or modifications may be made in the foregoing teachings without any restriction thereto and without departure from the spirit and scope of the invention as defined by the appended claims.

We claim:

1. A method of heat-treating a strip of metallic material in a continuous annealing furnace containing a radiant heating tube system and a plurality of gas jet nozzles arranged on one or both sides of the annealing furnace which comprises continuously introducing the strip of metallic material to be treated into the annealing furnace and heat-treating said metallic material with the heat from the radiant tube system and a heating or cooling gas introduced through said gas jet nozzles to the metallic strip, whereby the introduction of the heating or cooling gas cooperates with the radiant heat from the radiant tube systems for effectively controlling the temperature of the metallic strip being treated to the annealing temperature irrespective of changes in operating conditions such as the heat cycle, line speed, thickness of the metallic strip and the width of the metallic strip, and introducing said gas to said strip for the period of time until the temperature of the radiant tube system reaches a predetermined temperature so that the strip is always treated at its proper annealing temperature.

2. The method of heat-treating a strip of metallic material of claim 1 wherein the temperature of the heating or cooling gas is controlled by heating the gas in a heater, by passing the gas around the heater and by selectively blending desired portions of said heated and unheated by-pass gas and the flow rate thereof to achieve the desired temperature of the gas introduced to the metallic strip.

3. The method of heat-treating a strip of metallic material of claim 1 wherein the gas is introduced for short periods of time in anticipation of changes in operation conditions.

4. The method of heat-treating a strip of metallic material of claim 1 wherein the gas jet nozzles are disposed between adjacent radiant tubes.

5. The method of claim 4 wherein the intensity of radiant tube burners is changed before the operating conditions are changed and the temperature and flow rate of the gas are gradually changed in response to the change in temperature of the radiant tubes until the operating conditions are changed in order to maintain the temperature of the metal strip at a constant level.

* * * * *